US008413353B2

(12) United States Patent
Wagger et al.

(10) Patent No.: US 8,413,353 B2
(45) Date of Patent: Apr. 9, 2013

(54) HITCH DEVICE FOR CONNECTING A GROOMER VEHICLE AND A SKI SLOPE SNOW GROOMING IMPLEMENT, AND CONTROL METHOD EMPLOYING SUCH A HITCH DEVICE

(75) Inventors: Klaus Wagger, Brunico (IT); Jan Müller, Vipiteno (IT)

(73) Assignee: Rolic Invest S.AR.L., Luxembourg (LU)

( * ) Notice: Subject to any disclaimer, the term of this patent is extended or adjusted under 35 U.S.C. 154(b) by 0 days.

(21) Appl. No.: 12/740,951

(22) PCT Filed: Oct. 29, 2008

(86) PCT No.: PCT/EP2008/064693
§ 371 (c)(1),
(2), (4) Date: Aug. 13, 2010

(87) PCT Pub. No.: WO2009/056577
PCT Pub. Date: May 7, 2009

(65) Prior Publication Data

US 2011/0035968 A1 Feb. 17, 2011

(30) Foreign Application Priority Data

Oct. 30, 2007 (IT) ..... M12007A2096

(51) Int. Cl.
*E01H 4/00* (2006.01)

(52) U.S. Cl. ..... 37/223

(58) Field of Classification Search ..... 37/219, 37/223, 236, 245, 247, 234, 220, 222; 172/72, 172/123, 112
See application file for complete search history.

(56) References Cited

U.S. PATENT DOCUMENTS 3,170,533 A 2/1965 Fewel et al.
3,227,295 A 1/1966 Hamilton et al.
3,386,778 A 6/1968 Rymes
(Continued)

FOREIGN PATENT DOCUMENTS

CA 2211050 1/1998
CA 2443765 A1 4/2004
(Continued)

OTHER PUBLICATIONS

First Office Action for Chinese Application No. 200880117801.9, mailed Oct. 18, 2011 (10 pages).

(Continued)

*Primary Examiner* — Robert Pezzuto
(74) *Attorney, Agent, or Firm* — Neal, Gerber & Eisenberg LLP

(57) ABSTRACT

A hitch device for connecting a groomer vehicle having a first frame extending along a first axis, and an implement, in particular a rotary snow tiller, for grooming the snow covering of ski slopes and having a second frame extending crosswise to and symmetrically with respect to a second axis. The hitch device has an arm hinged to the first frame about a third axis perpendicular to the first axis, and about a fourth axis perpendicular to the first and third axis; a first actuator for adjusting the position of the arm about the third axis with respect to the first frame to lift and lower the implement; at least one second actuator for adjusting the position of the arm about the fourth axis with respect to the first frame; a movable coupling movable between the arm and one of the first and second frame; and a third actuator for adjusting the position of the arm in a plane crosswise to the fourth axis.

50 Claims, 4 Drawing Sheets

U.S. PATENT DOCUMENTS

| | | | |
|---|---|---|---|
| 3,534,701 | A | 10/1970 | Hebert |
| 3,692,132 | A | 9/1972 | Pollanen |
| 3,763,944 | A | 10/1973 | Kaltenegger |
| 4,087,135 | A | 5/1978 | Unruh |
| 4,348,825 | A | 9/1982 | Bachler |
| 4,458,954 | A | 7/1984 | Haas |
| 4,458,955 | A | 7/1984 | Webb |
| 4,500,139 | A | 2/1985 | Tucek |
| 4,788,783 | A | 12/1988 | Bachler |
| 5,062,493 | A | 11/1991 | Platter et al. |
| 5,067,263 | A | 11/1991 | Pelletier |
| 6,155,363 | A | 12/2000 | Matsumoto et al. |
| 6,296,330 | B1 | 10/2001 | Hall |
| 6,354,023 | B1 | 3/2002 | Trahan et al. |
| 6,418,645 | B1 | 7/2002 | Hammerle et al. |
| 6,637,134 | B2 | 10/2003 | Hammerle |
| 6,810,609 | B2 | 11/2004 | Lassonde et al. |
| 6,921,304 | B2 | 7/2005 | Hewitt |
| 6,983,927 | B2 | 1/2006 | Pelletier et al. |
| 7,464,699 | B2 | 12/2008 | Joppig et al. |
| 7,530,547 | B2 | 5/2009 | Leitner et al. |
| 2002/0139013 | A1 | 10/2002 | Hammerle |
| 2003/0051376 | A1 | 3/2003 | Lassonde et al. |
| 2003/0159840 | A1 | 8/2003 | Schmidt, Jr. |
| 2004/0069981 | A1 | 4/2004 | Pelletier et al. |
| 2005/0252592 | A1 | 11/2005 | Albright et al. |
| 2005/0279980 | A1 | 12/2005 | Leitner et al. |
| 2007/0130806 | A1 | 6/2007 | Goodman |
| 2008/0257616 | A1 | 10/2008 | Olsson |
| 2008/0269986 | A1 | 10/2008 | Regnell et al. |
| 2008/0309157 | A1 | 12/2008 | Runggaldier et al. |
| 2009/0000833 | A1 | 1/2009 | Dorais et al. |
| 2009/0007461 | A1 | 1/2009 | Pelletier et al. |
| 2009/0013562 | A1 | 1/2009 | Pelletier |

FOREIGN PATENT DOCUMENTS

| | | | |
|---|---|---|---|
| CN | 2584664 | | 11/2003 |
| CN | 2795280 | | 7/2006 |
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 10320523 | | 11/2004 |
| EP | 0551160 | | 7/1993 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | A1 | 1/2008 |
| EP | 1908673 | B1 | 9/2009 |
| EP | 1908672 | B1 | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 01144287 | | 10/1989 |
| JP | 03182887 | | 8/1991 |
| JP | 7237566 | | 9/1995 |
| WO | WO2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056576 | | 5/2009 |
| WO | WO2009056578 | | 5/2009 |
| WO | WO2009056579 | | 5/2009 |

OTHER PUBLICATIONS

Response to First Office Action for Chinese Application No. 200880117801.9 (3 pages).

PistenBully 600 brochure, written by Kassbohrer Gelandefahrzeug AG, published in Mar. 2010.

PistenBully Scout brochure, written by Kassbohrer Gelandefahrzeug AG, published in Jan. 2010.

HITCH DEVICE FOR CONNECTING A GROOMER VEHICLE AND A SKI SLOPE SNOW GROOMING IMPLEMENT, AND CONTROL METHOD EMPLOYING SUCH A HITCH DEVICE

PRIORITY CLAIM

This application is a national stage application of PCT/EP2008/064693, filed on Oct. 29, 2008, which claims the benefit of and priority to Italian Patent Application No. MI2007A 002096, filed on Oct. 30, 2007, the entire contents of which are incorporated herein.

TECHNICAL FIELD

The present disclosure relates to a hitch device for connecting a groomer vehicle and a ski slope snow grooming implement.

BACKGROUND

Known groomer vehicles are normally powered crawler vehicles comprising a frame extending along a first axis; and a snow grooming implement which is normally a rotary snow tiller drawn by the groomer vehicle and comprising a second frame extending predominantly crosswise to and symmetrically with respect to a second axis which, when traveling along a straight path, is aligned with the first axis, and, when traveling along a curved path, forms an angle with the first axis.

Such known hitch devices comprise an arm or so-called boom hinged to the first frame about a third axis perpendicular to the first axis, and about a fourth axis perpendicular to the first and third axis; a first actuator is connected to the first frame and the arm to adjust the position of the arm about the third axis with respect to the first frame; and at least one second actuator is connected to the first frame and the arm to adjust the position of the arm about the fourth axis.

The first actuator is often a hydraulic cylinder for lifting and lowering the arm to selectively lift and lower the rotary snow tiller with respect to the snow covering. The second actuator sets the angle between the first and second axis: when traveling along a straight path, the second actuator keeps the arm aligned with the first and second axis; and, when traveling along a curved path, the second actuator sets the arm to form a given angle with the first axis about the fourth axis.

Known hitch devices have proved highly effective, both in lifting and lowering the rotary snow tiller, and as regards maneuvering around bends and stabilizing the position of the tiller.

In some ski slope grooming conditions, however, it is necessary for the rotary snow tiller to go over an already groomed strip of the snow covering without the groomer vehicle traveling over it.

Known hitch devices allow this to be done, but force the rotary snow tiller to operate in a skew position with respect to the traveling direction, which increases energy consumption and reduces grooming width.

Moreover, when traveling along a curved path, known hitch devices are not always able to position the rotary snow tiller to cover the prints left by the groomer vehicle in the snow covering.

SUMMARY

It is an object of the present disclosure to provide a hitch device for connecting a groomer vehicle and a ski slope snow grooming implement, configured to eliminate certain of the drawbacks of the above-described known groomer vehicles.

According to the present disclosure, there is provided a hitch device for connecting a groomer vehicle comprising a first frame extending along a first axis, and an implement, in particular a rotary snow tiller, for grooming the snow covering of ski slopes and comprising a second frame extending crosswise to and symmetrically with respect to a second axis; the hitch device comprising an arm hinged to the first frame about a third axis perpendicular to the first axis, and about a fourth axis perpendicular to the first and third axis; a first actuator for adjusting the position of the arm about the third axis with respect to the first frame to lift and lower the implement; and at least one second actuator for adjusting the position of the arm about the fourth axis with respect to the first frame; and the hitch device being characterized by comprising a movable coupling movable between the arm and one of the first and second frame; and a third actuator for adjusting the position of the arm in a plane perpendicular to the fourth axis.

The present disclosure also relates to a control method.

According to the present disclosure, there is provided a method of controlling a hitch device for connecting a groomer vehicle comprising a first frame extending along a first axis, and an implement, in particular a rotary snow tiller, for grooming the snow covering of ski slopes and comprising a second frame extending crosswise to and symmetrically with respect to a second axis; the hitch device comprising an arm hinged to the first frame about a third axis perpendicular to the first axis, and about a fourth axis perpendicular to the first and third axis; the method comprising adjusting the position of the arm about the third axis with respect to the first frame to lift and lower the implement; and adjusting the position of the arm about the fourth axis with respect to the first frame; and the method being characterized by further adjusting the position of the arm in a plane perpendicular to the fourth axis; the arm being connected to one of the first and second frame by a movable coupling.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the accompanying drawings, in which.

DETAILED DESCRIPTION

Figure 1:
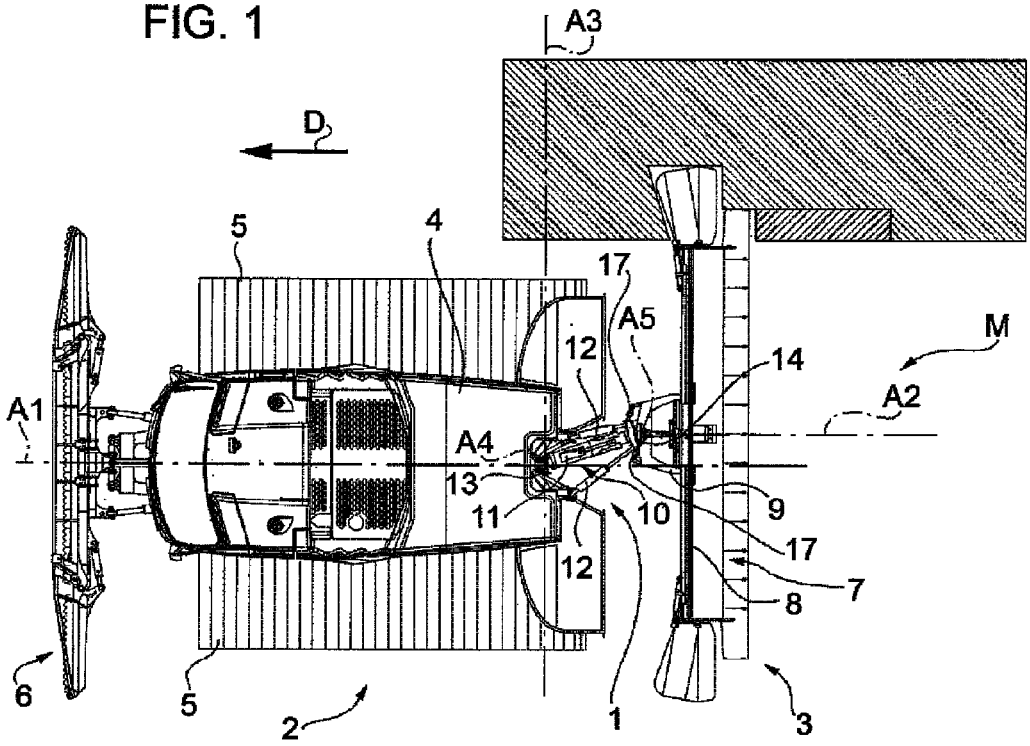
FIG. 1 shows a plan view, with parts removed for clarity, of a groomer vehicle connected to a snow grooming implement by a hitch device in accordance with the present disclosure and in a first operating position.
Figure 2:
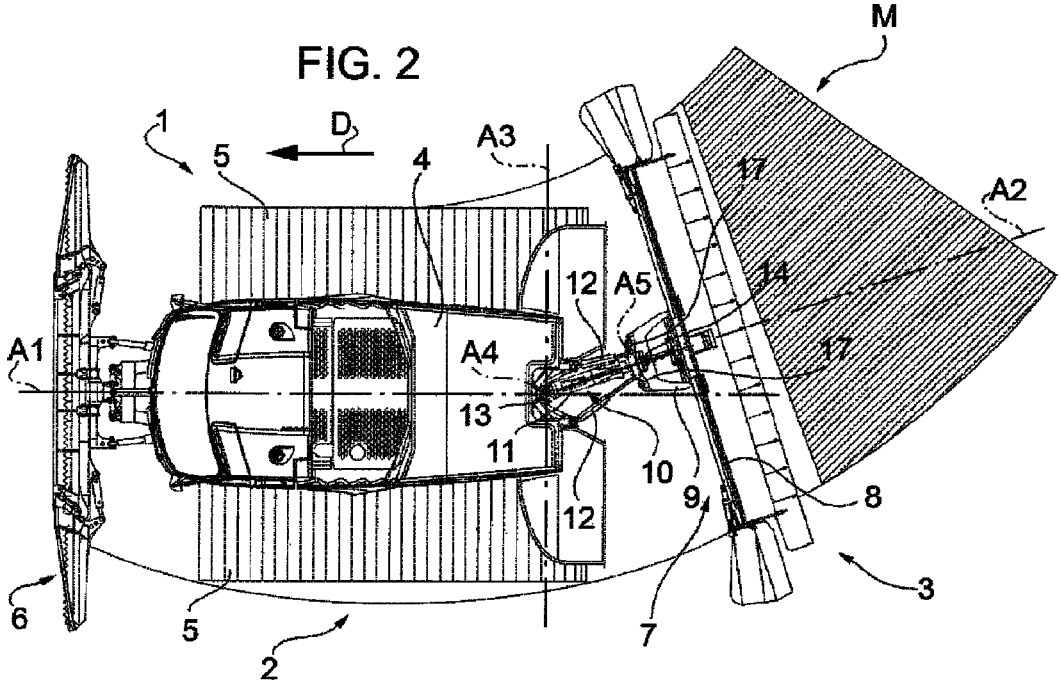
FIG. 2 shows a plan view, with parts removed for clarity, of the FIG. 1 groomer vehicle, snow grooming implement, and hitch device in a second operating position.

Referring now to the example embodiments of the present disclosure illustrated in FIGS. 1 to 5, number 1 in FIGS. 1 and 2 indicates as a whole a hitch device for connecting a groomer vehicle 2 and an implement 3, such as a rotary snow tiller, for grooming the snow covering M of ski slopes. Groomer vehicle 2 is powered and tows implement 3 along the ski slope, while the hitch device provides for controlling implement 3 according to the conditions imposed by the type of tilling operation to be performed.

Groomer vehicle 1 comprises a frame 4 extending predominantly along a central axis A1, two tracks 5 parallel to axis A1, and a shovel 6 connected to the front of frame 4, and is connected to implement 3 by hitch device 1, in turn connected to frame 4.

Implement 3 has a central axis A2, extends crosswise to the central axis A2, and comprises a frame 7, in turn comprising a bar 8 perpendicular to axis A2, and an arc-shaped bracket 9 connected rigidly to bar 8, located at the centreline of implement 3, and facing groomer vehicle 2.

Figure 3:
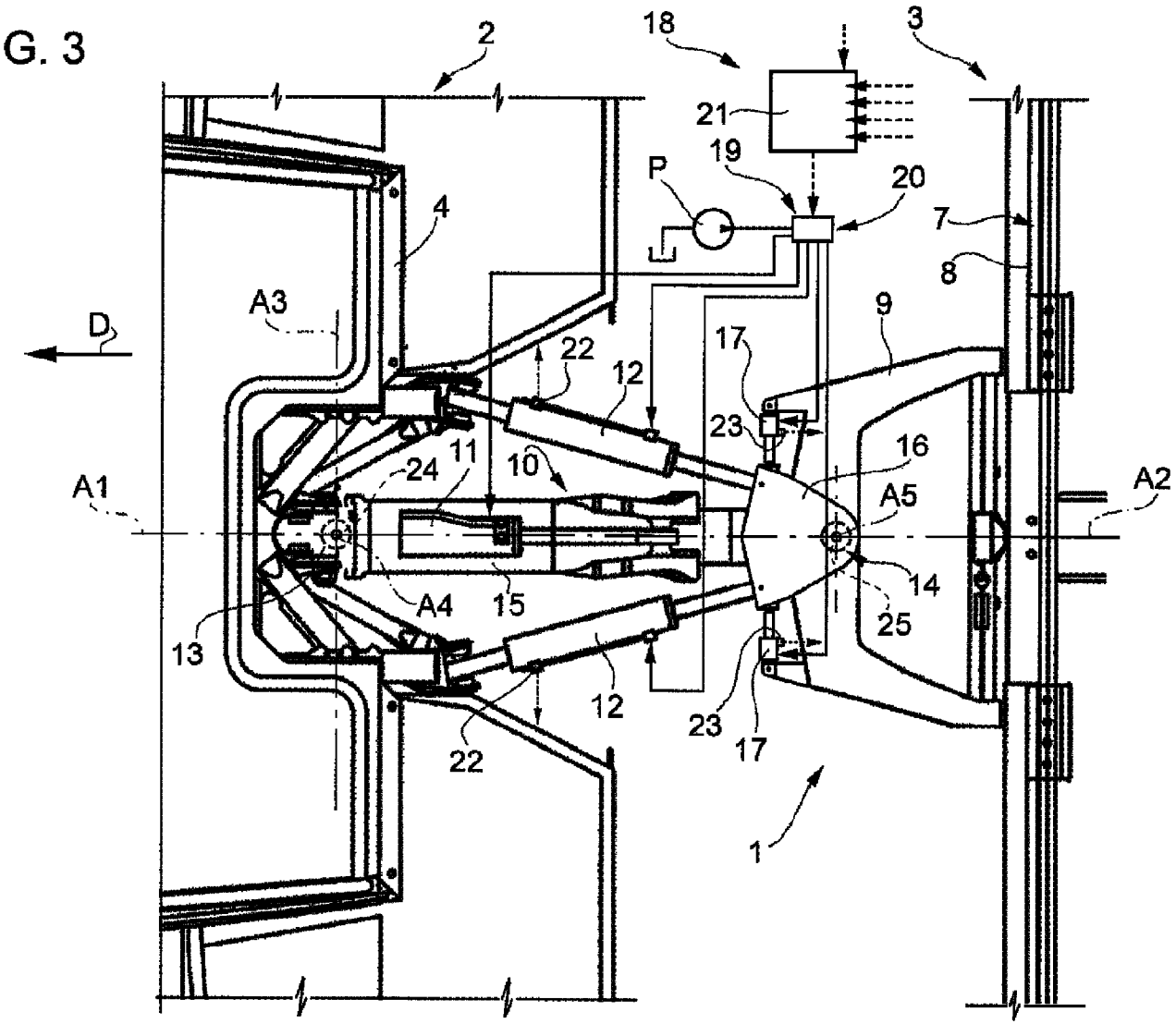
FIG. 3 shows a schematic, larger-scale plan view, with parts removed for clarity, of the FIG. 1 hitch device in a third operating position.

With reference to FIG. 3, hitch device 1 is connected to frame 4 and frame 7 at respective central axes A1 and A2, and comprises an arm 10 hinged to frame 4 about an axis A3; and an actuator 11, such as a hydraulic cylinder, connected to frame 4 and to arm 10 to rotate arm 10 about axis A3 to selectively lift and lower arm 10 and implement 3 with respect to snow covering M.

Arm 10 is hinged to frame 4 about an axis A4 perpendicular to axes A1 and A3, and comprises two actuators 12, such as two hydraulic cylinders, each connected to frame 4 and to arm 10 to control rotation of arm 10 about axis A4. Actuators 12 are located symmetrically on opposite sides of arm 10.

Hitch device 1 comprises a universal joint 13 between arm 10 and frame 4 to permit rotation about axes A3 and A4; and arm 10 is hinged to frame 7, such as by a hinge 14, about an axis A5 parallel to axis A4.

More specifically, arm 10 comprises a straight bar 15; and a plate 16 connected rigidly to one end of bar 15. Universal joint 13 is located at the opposite end of bar 15 to plate 16, and hinge 14 is located along plate 16.

Actuator 11 is located over bar 15 and hinged to frame 4 and bar 15; and each actuator 12 is located alongside bar 15 and hinged to frame 4 and plate 16.

Hitch device 1 comprises two actuators 17, each hinged to arm 10 and frame 7 to control rotation of frame 7 about axis A5 with respect to arm 10. In the example shown, actuators 17 connect bracket 9 to plate 16, and are symmetrical with respect to axis A2.

Hitch device 1 comprises a control device 18, in turn comprising a hydraulic circuit 19 connected to actuators 11, 12, 17 and equipped with an assembly 20 of valves to selectively supply actuators 11, 12, 17 along hoses (not shown); a control unit 21; linear sensors 22 associated with actuators 12; and linear sensors 23 associated with actuators 17.

Hydraulic circuit 19 comprises a pump P on board groomer vehicle 2 to pressure-feed circuit 19.

Control unit 21 receives target signals indicating the desired position of frame 7 with respect to frame 4 (i.e., the desired position of actuators 12 and 17), and actual-position signals, indicating the actual position of actuators 12 and 17, from linear sensors 22 and 23, and supplies valve assembly 20 with regulation signals calculated by control unit 21 according to the difference between the target signals and the actual-position signals.

With reference to FIG. 1, in actual use, groomer vehicle 2 advances and tows implement 3 in a traveling direction D. It should be appreciated that when traveling along a straight path, axes A1 and A2 are aligned, and arm 10 is parallel to axes A1 and A2, as shown in FIG. 3.

When traveling along a curved path, as shown in FIG. 2, axes A1 and A2 form an angle of other than 180°, and arm 10 is inclined with respect to frame 4 by an angle determined by actuators 12. In some cases, to cover the prints left by tracks 5 of groomer vehicle 2, it is necessary to rotate frame 7 with respect to arm 10 by actuators 17. When traveling along a curved path, the steering curve of grooming vehicle 2 is transmitted to control unit 21 which calculates the position of actuators 12 and 17 accordingly, so implement 3 can groom the portion of snow covering M on which prints have been left by tracks 5, as shown in FIG. 2.

Control unit 21 also provides for setting given offset values between axes A1 and A2, (i.e., advancing groomer vehicle 2 and implement 3 along a straight path), with axes A1 and A2 offset and parallel, as in the operating position shown in FIG. 1. The distance between axes A1 and A2 is set by a given rotation about axis A4, and by the same amount of rotation in the opposite direction about axis A5.

In each of the FIGS. 1 to 3, positioning of implement 3 with respect to groomer vehicle 2 is achieved and maintained by control unit 21, which compares the signals from sensors 22 and 23 with the target signals, and emits regulation signals when the sensor signals deviate from the target signals.

In one alternative embodiment, linear sensors 22 and 23 are eliminated, and control device 18 comprises two angle sensors 24 and 25 (shown by dash lines in FIG. 3) for respectively determining the angle between arm 10 and frame 4 about axis A4, and the angle between arm 10 and frame 7 about axis A5.

Figure 4:
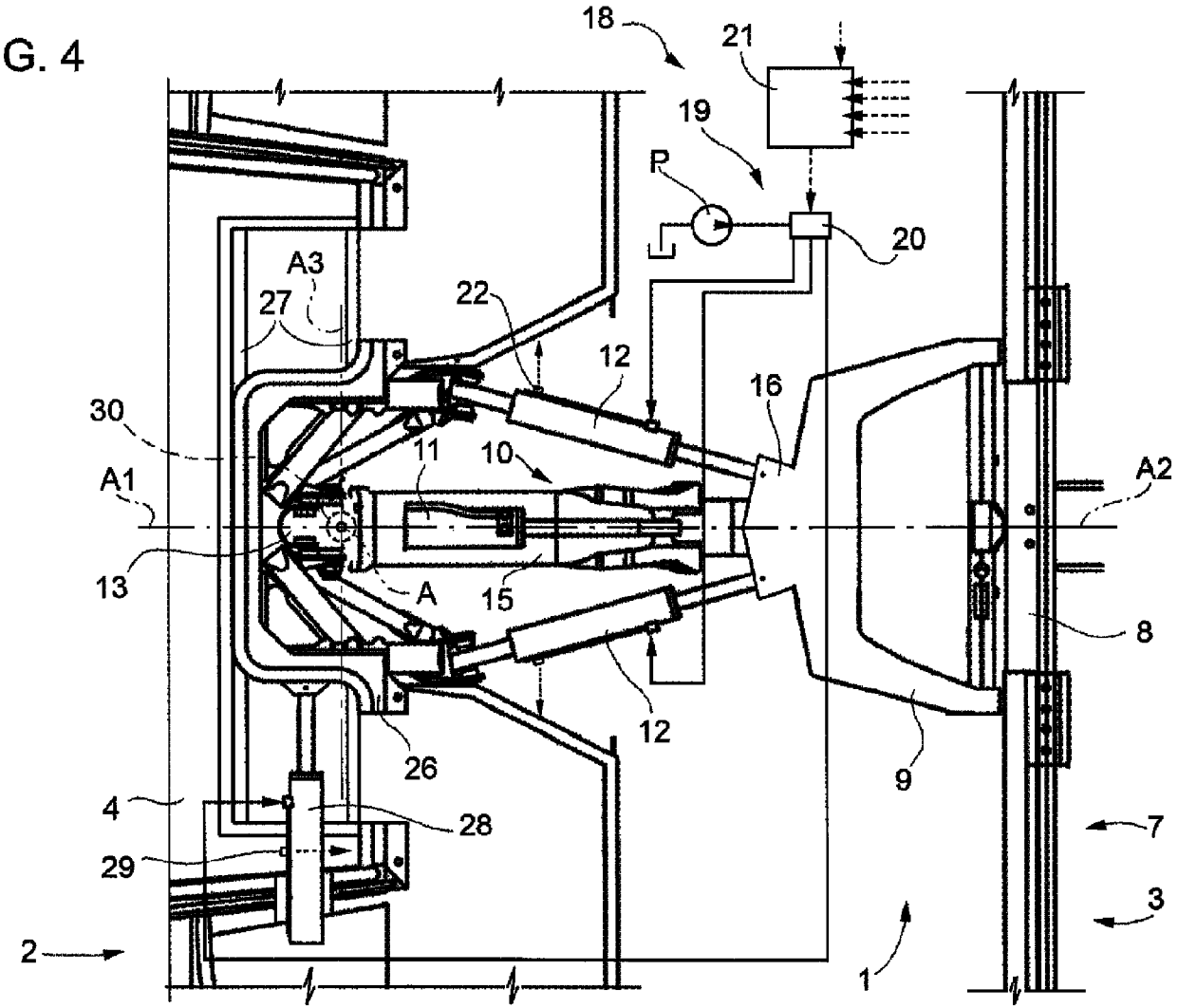
FIG. 4 shows a schematic plan view, with parts removed for clarity, of a hitch device in accordance with another embodiment of the present disclosure.

In the FIG. 4 embodiment, hitch device 1 comprises a slide 26 mounted to slide along a runner 27 parallel to axis A3; and an actuator 28 for selectively moving slide 26 along runner 27. Arm 10 is fixed rigidly to frame 7 in a position parallel to and aligned with axis A2, and is hinged about axes A3 and A4 with respect to slide 26. In this embodiment, actuators 12 are connected directly to slide 26 and arm 10, while actuators 17 are eliminated.

In addition to linear sensors 22 of respective actuators 12, control device 18 comprises a linear sensor 29 associated with actuator 28, while linear sensors 23 are eliminated.

In another embodiment, linear sensors 22 are replaced by an angle sensor 30 shown by a dash line in FIG. 4.

This embodiment operates in the same way as described above when traveling along a straight path, on which arm 10 is kept aligned with axes A1 and A2, and in fact cannot move with respect to axis A2. Axes A2 and A1 are offset by actuator 28 translating the whole of slide 26 along runner 27 by an amount equal to the desired amount of offset.

When traveling along a curved path, the position of implement 3 with respect to groomer vehicle 2, and of axis A2 with respect to axis A1, is achieved by rotating arm 10 about axis A4 and translating slide 26 with respect to frame 4.

Figure 5:
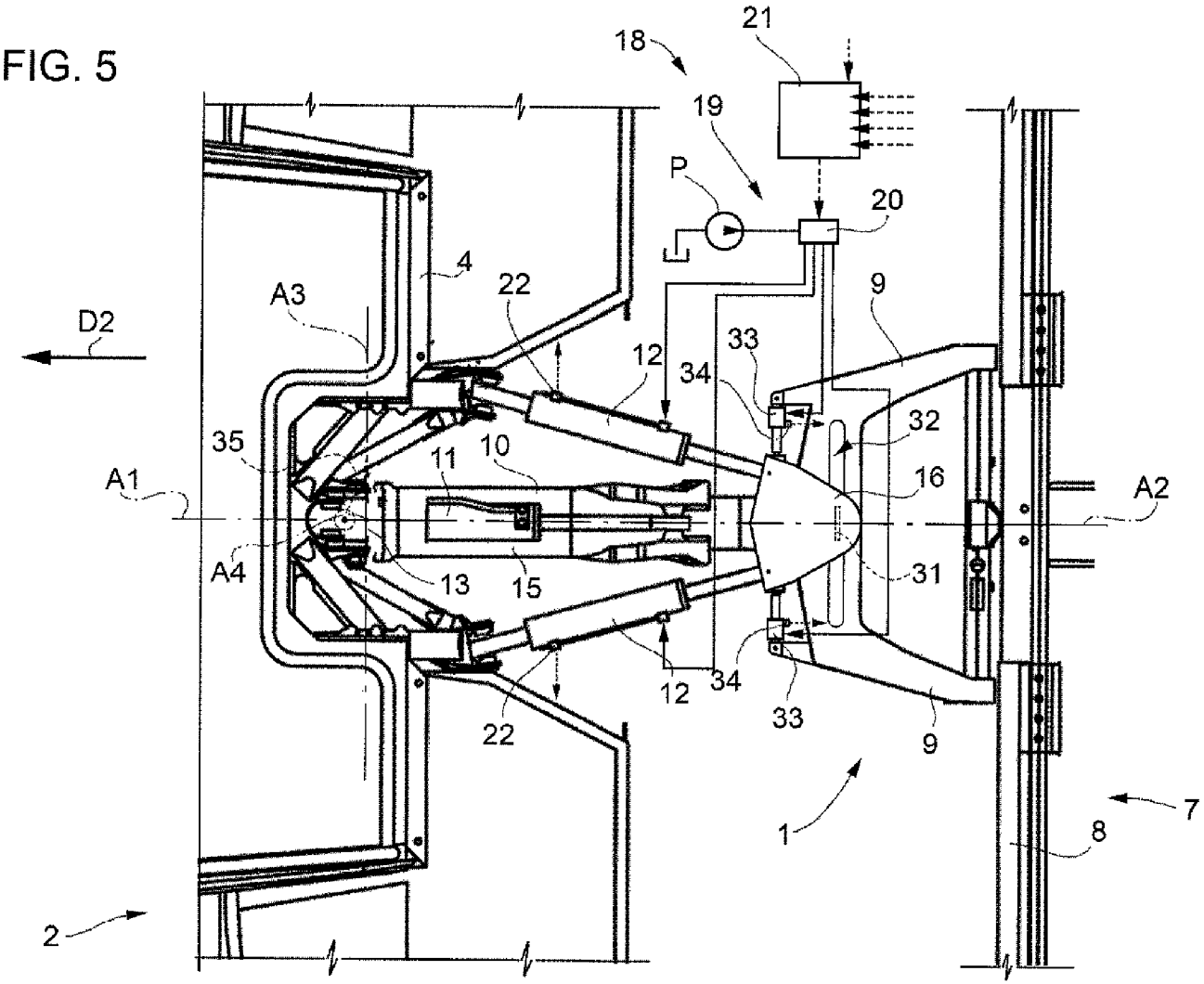
FIG. 5 shows a schematic plan view, with parts removed for clarity, of a hitch device in accordance with another embodiment of the present disclosure.

In the FIG. 5 embodiment, hitch device 1 is connected directly to frame 4 by universal joint 13, and is connected to frame 7 to slide in a direction perpendicular to axes A2 and A4. Plate 16 is integral with a slide 31 mounted to slide along a runner 32 of bracket 9 of frame 7. In this embodiment, hitch device 1 comprises two actuators 33 connected to frame 7 and slide 31 to selectively set slide 31 to a given position with respect to frame 7.

In addition to linear sensors 22 of respective actuators 12, control device 18 comprises two linear sensors 34, each associated with a respective actuator 33.

Instead of linear sensors 22, in one embodiment, control device 18 may comprise an angle sensor 35 shown by a dash line in FIG. 5.

This embodiment operates in the same way as described above, except that translation takes place between arm 10 and frame 7 as opposed to between arm 10 and frame 4.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A snow groomer hitch device configured to connect a snow groomer vehicle including a first frame extending along a first axis to a snow grooming implement including a second frame extending crosswise to a second axis, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

at least one second actuator configured to adjust the position of the arm about the fourth axis with respect to the first frame;

a third actuator configured to adjust the position of the arm in a plane perpendicular to the fourth axis, wherein the third actuator is connected to the arm and to the second frame to adjust the position of the second frame with respect to the arm about a fifth axis parallel to the fourth axis; and a coupling movable between the arm and one of the first frame and the second frame, wherein the coupling includes a hinge which hinges the arm and the second frame about the fifth axis.

2. The snow groomer hitch device of claim 1, which includes two third actuators connected to said arm and to the second frame, said two third actuators located on opposite sides of the arm.

3. The snow groomer hitch device of claim 1, which includes two second actuators located on opposite sides of the arm.

4. The snow groomer hitch device of claim 1, which includes a control device including:

a hydraulic circuit configured to supply the first actuator, the at least one second actuator, and the third actuator, and a control unit configured to emit regulation signals to adjust the hydraulic circuit.

5. The snow groomer hitch device of claim 4, wherein the control device includes a plurality of first sensors configured to determine the position of the arm with respect to the first frame, and to supply signals to the control unit.

6. The snow groomer hitch device of claim 4, wherein the control device includes a plurality of second sensors configured to determine the position of the arm with respect to the second frame and to supply signals to the control unit.

7. The snow groomer hitch device of claim 5, wherein said first sensors and a plurality of second sensors include a plurality of position sensors.

8. The snow groomer hitch device of claim 7, wherein said position sensors are selected from the group consisting of: linear sensors and angular sensors.

9. The snow groomer hitch device of claim 1, wherein the snow grooming implement includes a rotary snow tiller configured to groom a snow covering of a ski slope.

10. A method of controlling a snow groomer hitch device connecting a snow groomer vehicle including a first frame extending along a first axis to a snow grooming implement including a second frame extending crosswise to a second axis, the snow groomer hitch device including an arm hinged to the first frame about a third axis perpendicular to the first axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame;

adjusting the position of the arm in a plane perpendicular to the fourth axis, said arm being connected to one of the first frame and the second frame by a movable coupling;

determining the position of the arm with respect to the first frame by a plurality of position signals;

comparing the position signals with a plurality of target signals indicating a desired position; and emitting a regulation signal to activate a plurality of actuators to correct the position of the arm with respect to the first frame.

11. The method of claim 10, which includes:

determining the position of the arm with respect to the second frame by a plurality of second frame position signals;

comparing the second frame position signals with a plurality of second frame target signals indicating a desired second frame position; and emitting a second frame regulation signal to activate a second frame actuator to correct the position of the arm with respect to the second frame.

12. The method of claim 10, which includes:

rotating the arm by a first angle about the fourth axis with respect to the first frame; and rotating the second frame with respect to the arm about a fifth axis parallel to the fourth axis and by a second angle equal to and opposite the first angle.

13. The method of claim 10, which includes translating the arm with respect to the first frame in a direction parallel to the third axis.

14. The method of claim 10, which includes translating the second frame with respect to the arm in a direction perpendicular to the second axis and fourth axis.

15. The method of claim 10, wherein the snow grooming implement includes a rotary snow tiller configured to groom a snow covering of a ski slope.

16. A snow groomer hitch device configured to connect a snow groomer vehicle including a first frame extending along a first axis to a snow grooming implement including a second frame extending crosswise to a second axis, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

at least one second actuator configured to adjust the position of the arm about the fourth axis with respect to the first frame;

a coupling movable between the arm and one of the first frame and the second frame, wherein the coupling includes a slide and a runner located between the arm and the first frame, said slide configured to engage the runner to slide parallel to the third axis; and a third actuator configured to adjust the position of the arm in a plane perpendicular to the fourth axis and configured to adjust the position of the slide along the runner.

17. The snow groomer hitch device of claim 16, wherein said arm is hinged to said slide by a universal joint and the first actuator and the at least one second actuator are each connected to the slide and the arm.

18. The snow groomer hitch device of claim 16, which includes two second actuators located on opposite sides of the arm.

19. The snow groomer hitch device of claim 16, which includes a control device including:

a hydraulic circuit configured to supply the first actuator, the at least one second actuator, and the third actuator, and a control unit configured to emit regulation signals to adjust the hydraulic circuit.

20. The snow groomer hitch device of claim 16, wherein the snow grooming implement includes a rotary snow tiller configured to groom a snow covering of a ski slope.

21. A snow groomer hitch device configured to connect a snow groomer vehicle including a first frame extending along a first axis to a snow grooming implement including a second frame extending crosswise to a second axis, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

at least one second actuator configured to adjust the position of the arm about the fourth axis with respect to the first frame;

a coupling movable between the arm and one of the first frame and the second frame, wherein the coupling includes a slide and a runner located between the arm and the second frame, said slide configured to engage the runner to move in a direction perpendicular to the second axis and the fourth axis; and a third actuator configured to adjust the position of the arm in a plane perpendicular to the fourth axis and configured to adjust the position of the slide along the runner.

22. The snow groomer hitch device of claim 21, wherein said arm is hinged to the first frame by a universal joint, and is rigidly connected to the slide, said first actuator and said at least one second actuator each being connected to the first frame and the arm.

23. The snow groomer hitch device of claim 21, which includes two second actuators located on opposite sides of the arm.

24. The snow groomer hitch device of claim 21, which includes a control device including:

a hydraulic circuit configured to supply the first actuator, the at least one second actuator, and the third actuator, and a control unit configured to emit regulation signals to adjust the hydraulic circuit.

25. The snow groomer hitch device of claim 21, wherein the snow grooming implement includes a rotary snow tiller configured to groom a snow covering of a ski slope.

26. A snow groomer hitch device configured to connect a snow groomer vehicle including a first frame extending along a first axis to a snow grooming implement including a second frame extending crosswise to a second axis, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

two second actuators located on opposite sides of the arm and configured to adjust the position of the arm about the fourth axis with respect to the first frame;

a third actuator configured to adjust the position of the arm in a plane perpendicular to the fourth axis; and a coupling movable between the arm and one of the first frame and the second frame.

27. The snow groomer hitch device of claim 26, which includes a control device including:

a hydraulic circuit configured to supply the first actuator, the at least one second actuator, and the third actuator, and a control unit configured to emit regulation signals to adjust the hydraulic circuit.

28. The snow groomer hitch device of claim 26, wherein the snow grooming implement includes a rotary snow tiller configured to groom a snow covering of a ski slope.

29. A snow groomer hitch device configured to connect a snow groomer vehicle including a first frame extending along a first axis to a snow grooming implement including a second frame extending crosswise to a second axis, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

at least one second actuator configured to adjust the position of the arm about the fourth axis with respect to the first frame;

a third actuator configured to adjust the position of the arm in a plane perpendicular to the fourth axis;

a coupling movable between the arm and one of the first frame and the second frame; and a control device including:

a hydraulic circuit configured to supply the first actuator, the at least one second actuator, and the third actuator, and a control unit configured to emit regulation signals to adjust the hydraulic circuit.

30. The snow groomer hitch device of claim 29, wherein the control device includes a plurality of first sensors configured to determine the position of the arm with respect to the first frame, and to supply signals to the control unit.

31. The snow groomer hitch device of claim 30, wherein said first sensors and a plurality of second sensors include a plurality of position sensors.

32. The snow groomer hitch device of claim 31, wherein said position sensors are selected from the group consisting of: linear sensors and angular sensors.

33. The snow groomer hitch device of claim 29, wherein the control device includes a plurality of second sensors configured to determine the position of the arm with respect to the second frame and to supply signals to the control unit.

34. The snow groomer hitch device of claim 29, wherein the snow grooming implement includes a rotary snow tiller configured to groom a snow covering of a ski slope.

35. A snow groomer hitch device configured to connect a snow groomer vehicle including a first frame extending along a first axis to a snow grooming implement including a second frame extending crosswise to a second axis, the snow grooming implement including a rotary snow tiller configured to groom a snow covering of a ski slope, the snow groomer hitch device comprising:

an arm hinged to the first frame about a third axis perpendicular to the first axis, and about a fourth axis perpendicular to the first axis and the third axis;

a first actuator configured to: (i) adjust a position of the arm about the third axis with respect to the first frame to lift the snow grooming implement, and (ii) adjust the position of the arm about the third axis with respect to the first frame to lower the snow grooming implement;

at least one second actuator configured to adjust the position of the arm about the fourth axis with respect to the first frame;

a third actuator configured to adjust the position of the arm in a plane perpendicular to the fourth axis; and a coupling movable between the arm and one of the first frame and the second frame.

36. A method of controlling a snow groomer hitch device connecting a snow groomer vehicle including a first frame extending along a first axis to a snow grooming implement including a second frame extending crosswise to a second axis, the snow groomer hitch device including an arm hinged to the first frame about a third axis perpendicular to the first axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame;

adjusting the position of the arm in a plane perpendicular to the fourth axis, said arm being connected to one of the first frame and the second frame by a movable coupling;

determining the position of the arm with respect to the second frame by a plurality of position signals;

comparing the position signals with a plurality of target signals indicating a desired position; and emitting a regulation signal to activate an actuator to correct the position of the arm with respect to the second frame.

37. The method of claim 36, which includes:

rotating the arm by a first angle about the fourth axis with respect to the first frame; and rotating the second frame with respect to the arm about a fifth axis parallel to the fourth axis and by a second angle equal to and opposite the first angle.

38. The method of claim 36, which includes translating the arm with respect to the first frame in a direction parallel to the third axis.

39. The method of claim 36, which includes translating the second frame with respect to the arm in a direction perpendicular to the second axis and fourth axis.

40. The method of claim 36, wherein the snow grooming implement includes a rotary snow tiller configured to groom a snow covering of a ski slope.

41. A method of controlling a snow groomer hitch device connecting a snow groomer vehicle including a first frame extending along a first axis to a snow grooming implement including a second frame extending crosswise to a second axis, the snow groomer hitch device including an arm hinged to the first frame about a third axis perpendicular to the first axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame;

adjusting the position of the arm in a plane perpendicular to the fourth axis, said arm being connected to one of the first frame and the second frame by a movable coupling;

rotating the arm by a first angle about the fourth axis with respect to the first frame; and rotating the second frame with respect to the arm about a fifth axis parallel to the fourth axis and by a second angle equal to and opposite the first angle.

42. The method of claim 41, which includes translating the arm with respect to the first frame in a direction parallel to the third axis.

43. The method of claim 41, which includes translating the second frame with respect to the arm in a direction perpendicular to the second axis and fourth axis.

44. The method of claim 41, wherein the snow grooming implement includes a rotary snow tiller configured to groom a snow covering of a ski slope.

45. A method of controlling a snow groomer hitch device connecting a snow groomer vehicle including a first frame extending along a first axis to a snow grooming implement including a second frame extending crosswise to a second axis, the snow groomer hitch device including an arm hinged to the first frame about a third axis perpendicular to the first, axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame;

adjusting the position of the arm in a plane perpendicular to the fourth axis, said arm being connected to one of the first frame and the second frame by a movable coupling; and translating the arm with respect to the first frame in a direction parallel to the third axis.

46. The method of claim 45, which includes translating the second frame with respect to the arm in a direction perpendicular to the second axis and fourth axis.

47. The method of claim 45, wherein the snow grooming implement includes a rotary snow tiller configured to groom a snow covering of a ski slope.

48. A method of controlling a snow groomer hitch device connecting a snow groomer vehicle including a first frame extending along a first axis to a snow grooming implement including a second frame extending crosswise to a second axis, the snow groomer hitch device including an arm hinged to the first frame about a third axis perpendicular to the first axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame;

adjusting the position of the arm in a plane perpendicular to the fourth axis, said arm being connected to one of the first frame and the second frame by a movable coupling; and translating the second frame with respect to the arm in a direction perpendicular to the second axis and fourth axis.

49. The method of claim 48, wherein the snow grooming implement includes a rotary snow tiller configured to groom a snow covering of a ski slope.

50. A method of controlling a snow groomer hitch device connecting a snow groomer vehicle including a first frame extending along a first axis to a snow grooming implement including a second frame extending crosswise to a second axis, the snow grooming implement includes a rotary snow tiller configured to groom a snow covering of a ski slope, the snow groomer hitch device including an arm hinged to the first frame about a third axis perpendicular to the first axis, and about a fourth axis perpendicular to the first axis and the third axis, said method comprising:

adjusting a position of the arm about the third axis with respect to the first frame to lift the snow grooming implement;

adjusting the position of the arm about the third axis with respect to the first frame to lower the snow grooming implement;

adjusting the position of the arm about the fourth axis with respect to the first frame; and adjusting the position of the arm in a plane perpendicular to the fourth axis, said arm being connected to one of the first frame and the second frame by a movable coupling.

* * * * *

UNITED STATES PATENT AND TRADEMARK OFFICE

CERTIFICATE OF CORRECTION

PATENT NO. : 8,413,353 B2
APPLICATION NO. : 12/740951
DATED : April 9, 2013
INVENTOR(S) : Wagger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 393 days.

Signed and Sealed this
Twenty-third Day of September, 2014

Michelle K. Lee

Michelle K. Lee
*Deputy Director of the United States Patent and Trademark Office*